US009845720B2

(12) United States Patent
Rodecker

(10) Patent No.: US 9,845,720 B2
(45) Date of Patent: Dec. 19, 2017

(54) MICRO SHEAR HUB DUAL RING ISOLATOR

(71) Applicant: The Pullman Company, Milan, OH (US)

(72) Inventor: Troy P. Rodecker, Berlin Heights, OH (US)

(73) Assignee: The Pullman Company, Milan, OH (US)

( * ) Notice: Subject to any disclaimer, the term of this patent is extended or adjusted under 35 U.S.C. 154(b) by 0 days.

(21) Appl. No.: 15/091,210

(22) Filed: Apr. 5, 2016

(65) Prior Publication Data

US 2017/0044966 A1 Feb. 16, 2017

Related U.S. Application Data

(60) Provisional application No. 62/203,659, filed on Aug. 11, 2015.

(51) Int. Cl.

| | |
|---|---|
| ***F16M 13/00*** | (2006.01) |
| ***F01N 13/18*** | (2010.01) |
| ***F01N 13/16*** | (2010.01) |

(52) U.S. Cl.

CPC ..... *F01N 13/1822* (2013.01); *F01N 13/16* (2013.01); *F01N 2530/22* (2013.01)

(58) Field of Classification Search

CPC ..... F01N 13/1811; F16F 1/3732; F16F 1/387
See application file for complete search history.

(56) References Cited

U.S. PATENT DOCUMENTS

| | | | | |
|---|---|---|---|---|
| 5,704,597 | A * | 1/1998 | Hofmann | F16F 1/387 267/140.12 |
| 5,960,512 | A * | 10/1999 | Schael | B60S 1/04 15/250.31 |
| 6,758,300 | B2 | 7/2004 | Kromis et al. | |
| 7,354,031 | B2 * | 4/2008 | Okanaka | F16F 1/3842 267/140.12 |
| 7,510,043 | B2 | 3/2009 | Cerri, III | |
| 7,644,911 | B2 | 1/2010 | Rodecker | |
| 8,066,266 | B2 | 11/2011 | Rodecker | |
| 8,152,146 | B2 | 4/2012 | Rodecker | |
| 8,376,331 | B2 | 2/2013 | Rodecker | |
| 8,646,761 | B2 | 2/2014 | Rodecker | |
| 2009/0315235 | A1 | 12/2009 | Rodecker | |

FOREIGN PATENT DOCUMENTS

| | | | |
|---|---|---|---|
| JP | H05106670 | A | 4/1993 |
| JP | H09112632 | A | 5/1997 |
| JP | 2002037092 | A | 2/2002 |
| JP | 2010180930 | A | 8/2010 |
| JP | 2014059018 | A | 4/2014 |

* cited by examiner

*Primary Examiner* — Amy Sterling
(74) *Attorney, Agent, or Firm* — Harness, Dickey & Pierce, P.L.C.

(57) ABSTRACT

The present disclosure relates to an isolator assembly for supporting an exhaust component from a structural portion of a vehicle. The isolator assembly has a mounting bracket having a pair of spaced apart rings defining a mounting bore. An elastomer shear hub component is disposed within the mounting bracket and has an outer diameter (OD) shear hub extending between the pair of spaced apart rings, and an inner diameter (ID) shear hub disposed within the OD shear hub. The ID shear hub defines a central mounting bore adapted to receive an external hanger component.

27 Claims, 5 Drawing Sheets

MICRO SHEAR HUB DUAL RING ISOLATOR

CROSS-REFERENCE TO RELATED APPLICATIONS

This application claims the benefit of U.S. Provisional Application No. 62/203,659, filed on Aug. 11, 2015. The entire disclosure of the above application is incorporated herein by reference.

FIELD

The present disclosure relates general to an automotive exhaust system isolator. More particularly, the present disclosure relates to an isolator which is configured to provide a very soft on-center rate but yet have even the ability to endure spike durability loads.

BACKGROUND

The statements in this section merely provide background information related to the present disclosure and may not constitute prior art.

Typically, automotive vehicles including cars and trucks have an internal combustion engine which is coupled to at least a transmission and a differential for providing power to the drive wheels of the vehicle. An engine exhaust system which typically includes an exhaust pipe, a catalytic converter and a muffler is attached to the engine to quiet the combustion process, to clean the exhaust gases and to route the products of combustion away from the engine to a desired position typically at the rear of the vehicle. The exhaust system is supported by exhaust mounts which are positioned between the exhaust system and the frame or some other supporting structure of the vehicle body. In order to prevent engine vibrations from being transmitted to the car body, the exhaust mounts incorporate flexible members or elastic suspension members to isolate the vehicle's exhaust system from the vehicle's body. In order to effectively isolate the vehicle's exhaust system from the vehicle's body, it is preferred that the isolator include a soft on-center rate of deflection.

The common prior art exhaust mounts or isolators have included two-hole pendulum rubber isolators which include a solid rubber component or a puck that is at least three-quarters of an inch thick and which is provided with at least one pair of apertures extending therethrough. The apertures each receive an elongated metal stud hanger. The metal stud hanger is often provided with an enlarged tapered head that can be forced through the aperture in the isolator, but which cannot be readily removed from the isolator. The opposite end of the hanger is welded to or otherwise secured to either a support point in the vehicle or to one of the components of the exhaust system.

Other designs for isolators include elastomeric moldings having a 1-hole spoke design wherein spokes are loaded in tension and compression, elastomeric moldings having a 1-hole shear leg design that include a pair of molded legs subjected to shearing in the primary loading direction, and elastomeric moldings having a bell-shaped design.

Most high temp elastomers utilized in exhaust isolator assemblies exhibit poor tensile fatigue properties stemming from low tear strength properties. It is therefore preferred to load the elastomeric material in compression or shear. For example, the puck design, as discussed above, provides for two pins to be inserted at opposite ends of the elastomeric element which allows loading in tension on the elastomer cords connecting both ends. While this is typically the lowest cost design, it is also the most abusive to the material. In order to offset the failure risk, flexible and/or rigid bands are typically designed inside or around the outside of the elastomeric puck.

Spoke design isolators load the elastomeric material in compression and tension. The tensile loading makes the design vulnerable to fractures in overloaded conditions. The stress magnitude is directly proportional to the load divided by the minimum spoke cross-sectional area. An additional requirement of the spoke design is that the mating component or hanger pin be centered within the deflection zone while statically preloaded by the weight of the exhaust. If it is not, the voids designed into the isolator will be bottomed out or positioned in a groundout condition. This results in the soft on-center rate not being employed, thus defeating the purpose of the isolator.

Shear leg design isolators have a primary loading direction which is typically vertical and a secondary loading direction which is typically lateral. When the shear leg design is loaded in its primary loading direction, the loading method is the preferred shear style loading. Shear style loading is able to be designed desirably soft. However, the secondary loading direction inflicts tensile compressive stresses which are unfavorable for durability. In addition, the secondary loading direction has a rate that is two to three times stiffer than the primary rate which is also an unfavorable condition.

The continued development of elastomeric mounts has been directed to elastomeric mounts which include a soft on-center rate while avoiding the undesirable tension loading of the elastomeric bushing and which avoid the vulnerable stress concentrations. While this has been achieved in the prior art shear-hub designs, stress concentrations at the ends of the voids continues to be an issue.

SUMMARY OF THE INVENTION

In one aspect the present disclosure relates to an isolator assembly for supporting an exhaust component from a structural portion of a vehicle. The isolator assembly may comprise a mounting bracket having a pair of spaced apart rings defining a mounting bore. An elastomer shear hub component may be disposed within the mounting bracket. The elastomer shear hub component may include an outer diameter (OD) shear hub extending between the pair of spaced apart rings, and an inner diameter (ID) shear hub disposed within the OD shear hub. The ID shear hub may define a central mounting bore adapted to receive an external hanger component.

In another aspect the present disclosure relates to an isolator assembly for supporting an exhaust component from a structural portion of a vehicle. The isolator assembly may comprise a mounting bracket having a pair of spaced apart circumferential rings defining a circular mounting bore. An elastomer shear hub component may be included which is disposed within the mounting bracket. The elastomer shear hub component may include an outer diameter (OD) shear hub extending between the pair of spaced apart rings, and an inner diameter (ID) shear hub disposed within the OD shear hub and connected to the OD shear hub via a transition portion. The ID shear hub may include a pair of ID shear hub portions extending in generally opposite directions that define a common, central mounting bore adapted to receive an external hanger component.

In still another aspect the present disclosure relates to an isolator assembly for supporting an exhaust component from a structural portion of a vehicle. The isolator assembly may comprise a mounting bracket having a pair of spaced apart circumferential rings defining a circular mounting bore, and a bottom wall having an aperture. An elastomer shear hub component may be disposed within the mounting bracket. The elastomer shear hub component may include an outer diameter (OD) shear hub extending between the pair of spaced apart circumferential rings, and an inner diameter (ID) shear hub disposed within the OD shear hub and connected to the OD shear hub via a transition portion. The ID shear hub may include a pair of mirror image ID shear hub portions extending in generally opposite directions that define a co-linear central mounting bore adapted to receive an external hanger component. The mirror image pair of ID shear hub portions may be coupled at an approximate midpoint along an axial length thereof to an approximate midpoint of the OD shear hub by the transition portion.

Further areas of applicability will become apparent from the description provided herein. It should be understood that the description and specific examples are intended for purposes of illustration only and are not intended to limit the scope of the present disclosure.

DETAILED DESCRIPTION

The following description of the preferred embodiment(s) is merely exemplary in nature and is in no way intended to limit the disclosure, its application, or uses.

Figure 1:
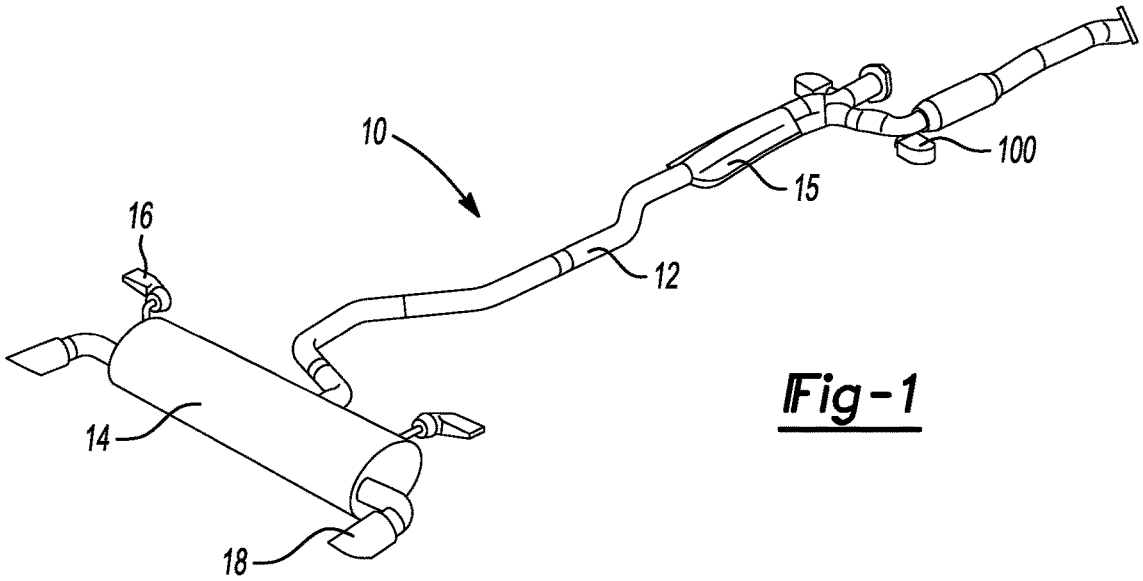
FIG. 1 is an isometric view of a vehicle exhaust system.

Referring now to the drawings, there is shown in FIG. 1 a vehicle exhaust system 10 which includes the exhaust system isolators 100 in accordance with the present invention and which is designated generally by the reference numeral 100. A typical vehicle comprises an internal combustion engine (not shown), a body (not shown), a suspension system (not shown) and exhaust system 10 which is attached to the internal combustion engine and which is supported typically beneath the vehicle. The internal combustion engine is designed to power one or more drive wheels of the vehicle and the exhaust system routes the products of combustion to a desired exhaust location around the outside of the vehicle.

Exhaust system 10 comprises a muffler 14, an intermediate pipe 12, a catalytic converter 15, an exhaust hanger pin 16, a tailpipe 18 and a plurality of isolator assemblies 100 of various designs. Intermediate pipe 12 is typically connected to the engine or to a catalytic converter 15 which is then attached to an exhaust pipe which extends between the engine and the catalytic converter. The catalytic converter 15 may be attached to a single exhaust pipe which leads to a single exhaust manifold or the catalytic converter can be attached to a branched exhaust pipe which leads to a plurality of exhaust pipes which lead to a plurality of exhaust manifolds. In one alternative embodiment, intermediate pipe 12 can be attached to a plurality of catalytic converters which join together upstream of the muffler 14. In another alternative, the vehicle can have a plurality of exhaust pipes, a plurality of catalytic converters, a plurality of intermediate pipes and a plurality of mufflers which join together. It is further understood that an exhaust system may include a single tailpipe or multiple tailpipes. It should be further appreciated that, the exhaust system isolator of the present invention may be applied to any type of exhaust system including but not limited to dual exhaust systems having two parallel exhaust paths extending from the internal combustion system.

Exhaust system 10 is utilized to route the exhaust gases from the engine to a desired location around the outside of the vehicle. While traveling through the exhaust system, the catalytic converter 15 cleans the exhaust gases and muffler 14 quiets the noise created during the combustion process in the engine. The present invention is directed toward the exhaust system isolators 100 which mount exhaust system 10 to the vehicle while at the same time, isolate and damp the movement of exhaust system 10 with respect to the vehicle.

Figure 2:
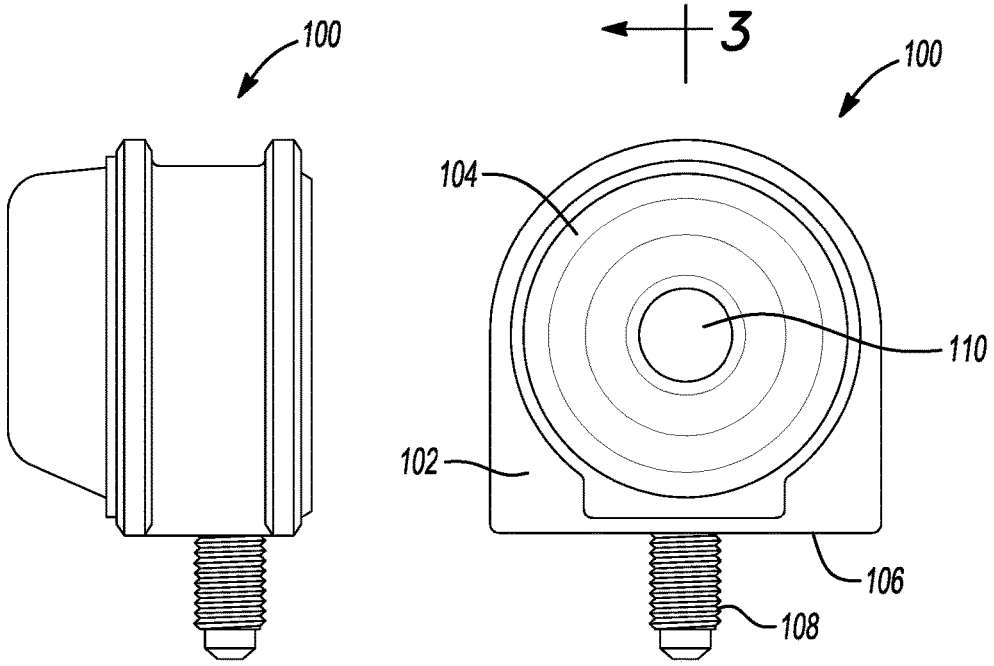
FIG. 2 includes a front view and a side view of a shear hub isolator in accordance with a first embodiment of the present invention.
Figure 3:
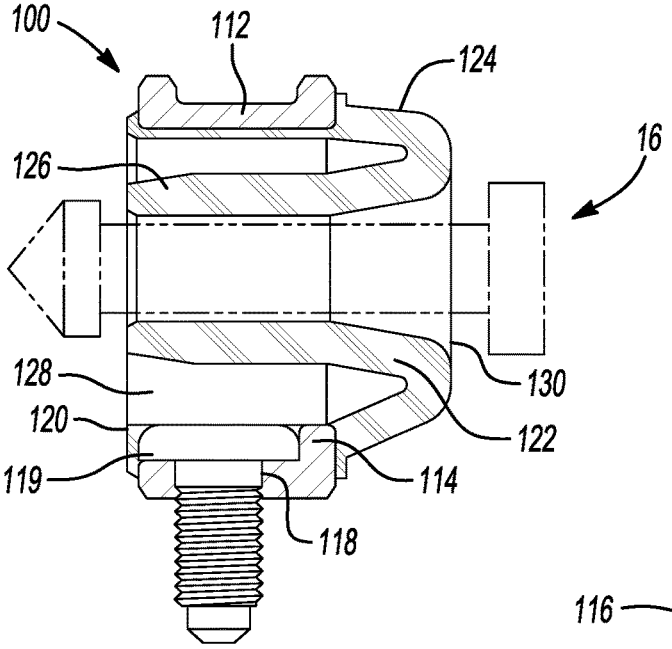
FIG. 3 is a cross-sectional view of the shear hub isolator of FIG. 2.
Figure 4:
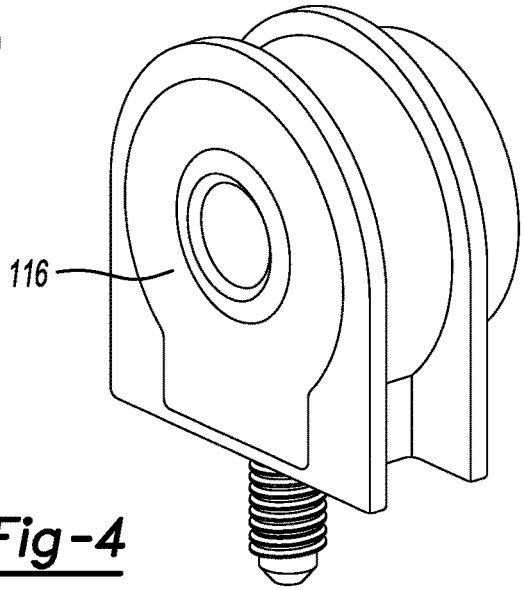
FIG. 4 is a semi-transparent, isometric view of the shear hub isolator of FIG. 2.

Referring now to FIGS. 2-4, an exhaust system isolator assembly 100 comprises a mounting bracket 102 and an elastomeric body 104 positioned within the mounting bracket. The mounting bracket 102 is a metal or plastic component which defines a bracket mounting bore 112 for elastomeric body 104. Within the bracket mounting bore 112, a fastener 108 (best seen in FIG. 3 as a T-bolt) is provided for securing exhaust system isolator assembly 100 to a vehicle frame or another structural component of the vehicle. While FIG. 2 illustrates bracket mounting face 106 being generally perpendicular to a front face 102*a* of the bracket 102, it is within the scope of the present disclosure to arrange bracket mounting face 106 in any orientation which is required to have bracket 102 properly interface with the mounting structure of the vehicle.

Referring now to FIG. 3, isolator bracket 102 includes in inner circumferential surface defining a bracket mounting bore 112 that is bonded to the elastomeric body 104. The bracket mounting bore 112 includes a bolt-head pocket 116 (FIG. 4) which is cut out of the isolator bracket 102, or otherwise formed in the isolator bracket, to provide a space for a bolt-head 118*a* of the fastener 108. The bracket mounting bore 112 includes a leading edge 114 adjacent the bolt-head pocket 116 that provides for a constant ground out rate in all directions including the direction of the bolt head pocket 116. The general shape of the bolt head pocket 116 may be square or any other shape to prevent rotation of the fastener 108 during assembly. An aperture 118 is further provided between the bolt head pocket 116 and the bracket mounting face 106. The tight fit between a shoulder (not shown) of the fastener 108 and the aperture 118, as well as the bolt head 118*a* to bolt head pocket 116 contact 119, acts to seal the aperture 118 from leakage during the molding of the elastomeric body 104. Encapsulating a bolt head 120 of the fastener 108 within the isolator assembly 100 provides a more compact design.

The elastomeric body 104 further comprises an OD shear hub 124, an ID shear hub 122, and a ground-out hub 126. The elastomeric body 104 defines a central mounting bore 110 which is designed to accept an inner tube, a bolt, or a hanger pin 16. Hanger pin 16 can further include a head and collar that act as hanger slide limiters. Hanger pin 16 is attached to a component of exhaust system 10. While bracket 102 is disclosed as being attached to a structural component of the vehicle and elastomeric body 104 is disclosed as being attached to a component of exhaust system 10, using hanger pin 16, it is within the scope of the present disclosure to have bracket 102 attached to exhaust system 10 and exhaust system isolator assembly 100 attached to a structural component of the vehicle using hanger pin 16. Thus, exhaust system 10 is secured to the vehicle through one or more exhaust system isolator assemblies 100.

Elastomeric body 104 includes a chamfer 130 located at one end of mounting bore 110. Chamfer 130 interfaces with the hanger pin 16. In at least one preferred embodiment, the chamfer 130 is tunable, typically ending flush to a leading edge of the isolator bracket 102. In at least one embodiment, the diameter of the chamfer is tuned such that the wall thickness of the OD shear hub 124 is equal to the wall thickness of the ID shear hub 122. Elastomeric body 104 defines a circumferential annular void 128. While annular void 128 is illustrated as being asymmetrical with respect to bracket mounting bore 112, it is within the scope of the present disclosure to have annular void 128 symmetrical with bracket mounting bore 112. The asymmetrical design for annular void 128 permits central mounting bore 110 to become disposed at or near the centerline of the bracket mounting bore 112 during the assembled or statically loaded condition of exhaust system isolator assembly 100. This is accomplished by molding mounting bore 110 vertically offset.

The design of both void 128 and chamfer 130, particularly the radial dimension of void 128 and the radial thickness of chamfer 130, will determine the distance a hanger pin disposed within the mounting bore 110 may radially translate with respect to the bracket mounting bore 112. Until the closing of void 128 and/or chamfer 130, the radial movements of central mounting bore 110 cause pure shear in elastomeric body 104 regardless of the loading direction. This shear loading occurs in the portion of elastomeric body 104 disposed between structural bracket mounting face 106 and hanger pin 16 as discussed below. Tuning for rate and deflection in selected directions can be accomplished independently from other directions by altering void 128 and chamfer 130 in the selected direction or by adding voids at specific circumferential positions of elastomeric body 104.

As can be seen in the figures, void 128 extends beyond bracket 102 and overlaps chamfer 130 in the axial direction to define the ID shear hub 122. The ID shear hub 122 which undergoes the shear loading due to the deflection of elastomeric body 104. During larger loading of exhaust system isolator assembly 100, void 128 and chamfer 130 will close and compressive stresses are imparted to elastomeric body 104 by the sandwiching of the ground-out hub 126 of the elastomeric body 104 between hanger pin 16 and bracket mounting bore 112. This contact between hanger pin 16, ground-out hub 126 and bracket mounting bore 112 eliminates the compression and thus the compression stresses on the OD shear hub 124 and the ID shear hub 122 when isolator assembly 100 experiences high ground-out loads. This improves both the performance and the reliability of exhaust system isolator assembly 100.

Exhaust system isolator assembly 100 avoids tension stress loading in the elastomeric body 104 during radial loading. The shear style loading in all directions enables exhaust system isolator assembly 100 to achieve a lower and more stable rate of deflection. This is because the shear modulus (shear loading) is lower than the elasticity modulus (tensile loading). Also, the spring rate of elastomeric materials in shear is more consistent than in tension. The rates and deflections are capable of being symmetrical about the center axis or they can be tuned using annular void 128 and chamfer 130 or by otherwise altering the size or shape of elastomeric body 104 or the rigid structures. An additional advantage is that the rate of deflection for ID shear hub 122 is linear throughout the deflection (until void 128 closes), which adds robustness to the design in regards to the position. This means that any pre-load from positional tolerances will not spike the rates of deflection and make the Noise, Vibration and Harshness (NVH) of the vehicle change with the exhaust geometry tolerances.

Figure 5:
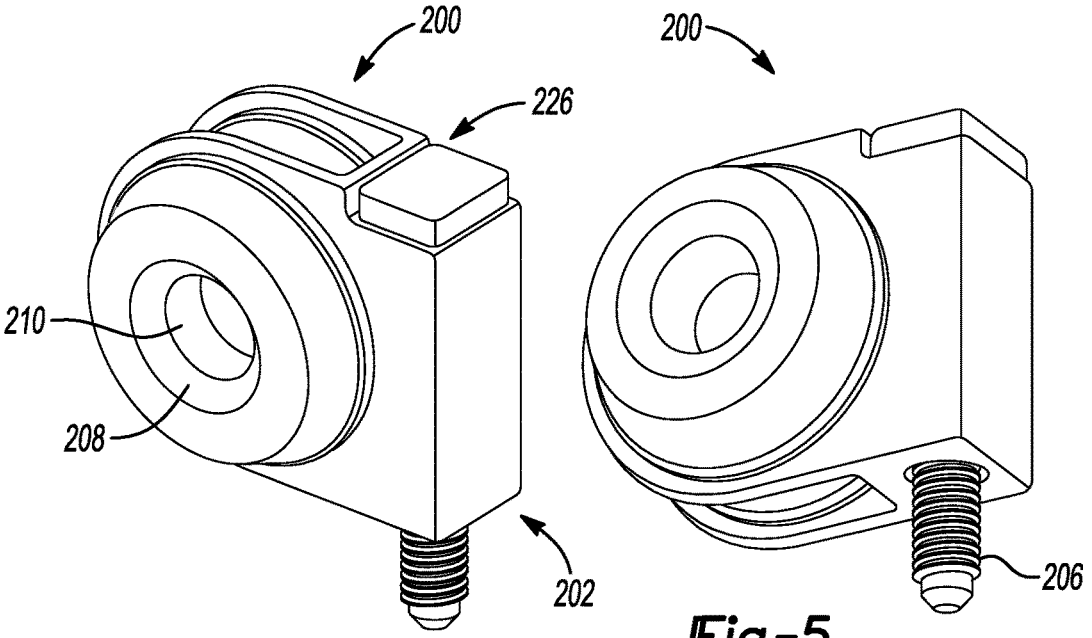
FIG. 5 includes two isometric views of a shear hub isolator in accordance with a second embodiment of the present invention.

FIG. 5 illustrates an alternative embodiment of an exhaust isolator assembly 200. This assembly 200 includes a hanger bracket 202, an elastomeric body 208, and a fastener 206. A "pocket" 226 is formed in the hanger bracket 202 to prevent rotation of the fastener 206 during assembly to the vehicle. The elastomeric body 208 includes a central mounting bore 210 to accommodate a rod hanger (not shown). In other respects, the isolator assembly 200 resembles the isolator assembly 100. While not shown, it is understood that isolator assembly 200 includes ID and OD shear hubs, as well as a ground out hub, an annular void, and a chamfer as shown on isolator assembly 100.

Figure 6:
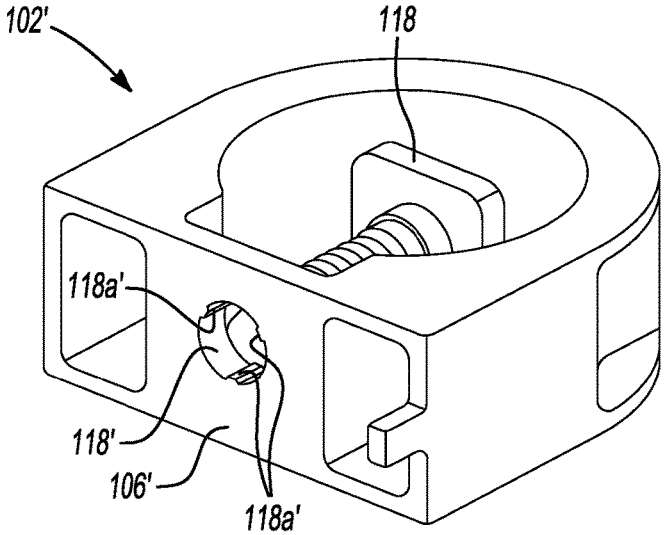
FIG. 6 is a cross sectional plan view of a portion of another embodiment of the isolator mounting bracket showing a plurality of staking ribs which are used to engage a fastener, and to relieve stress on the bracket from its press-fit fastener.

Referring to FIG. 6, another embodiment of a hanger bracket 102' is shown. Hanger bracket 102' is the otherwise identical to hanger bracket 102 with the exception that a bracket mounting face 106' includes a clearance fit opening 118' instead of the press fit aperture 118, and the opening 118' includes a plurality of spaced apart, interference fit staking ribs 118*a*'. The opening 118' helps to alleviate any excessive hoop stress on the bracket hole, while the staking ribs 118*a*' fixture the fastener head until rubber overmolding.

Figure 7:
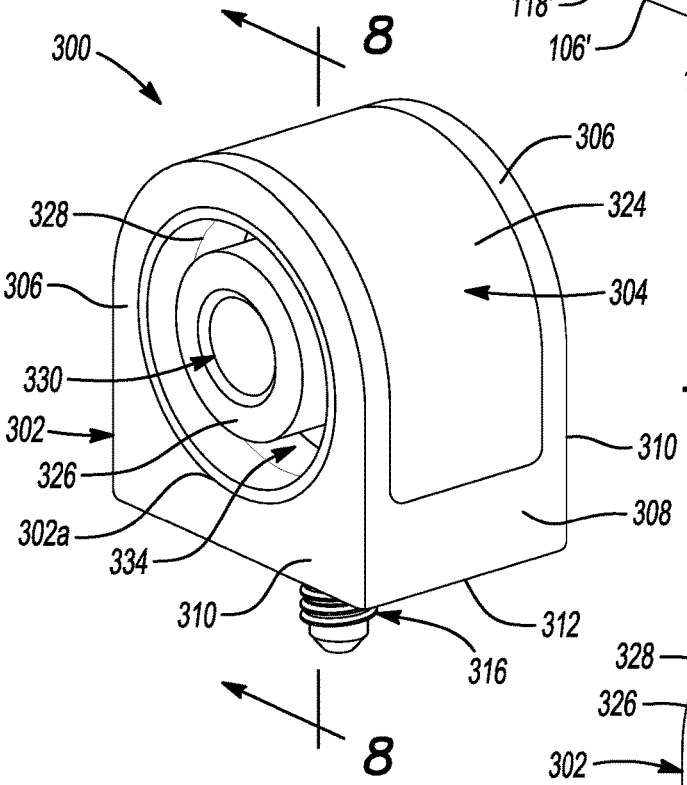
FIG. 7 is a perspective view of another embodiment of the present disclosure that incorporates a dual ring mounting bracket with an outer diameter ("OD") shear hub and a mirror image pair of inner diameter ("ID") shear hubs.
Figure 8:
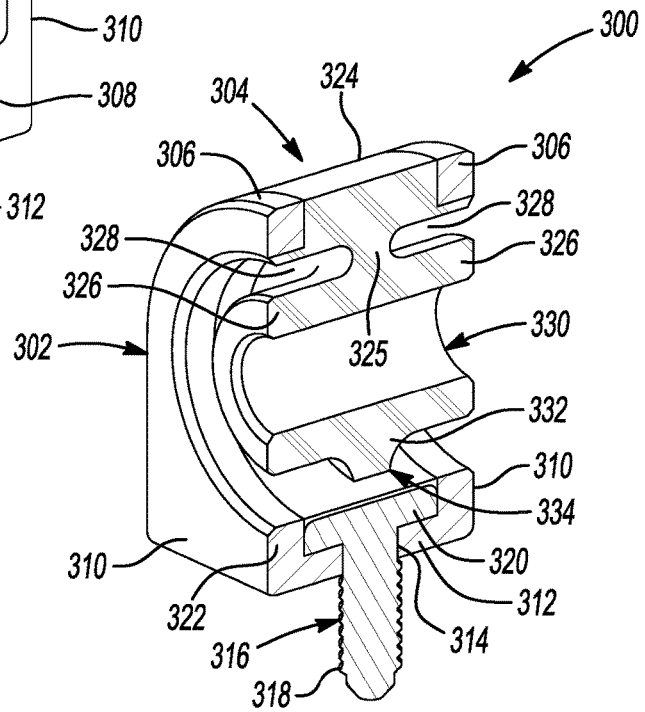
FIG. 8 is a cross-sectional view taken in accordance with section line 8-8 in FIG. 7 better showing the mirror image pair of ID shear hubs.
Figure 9:
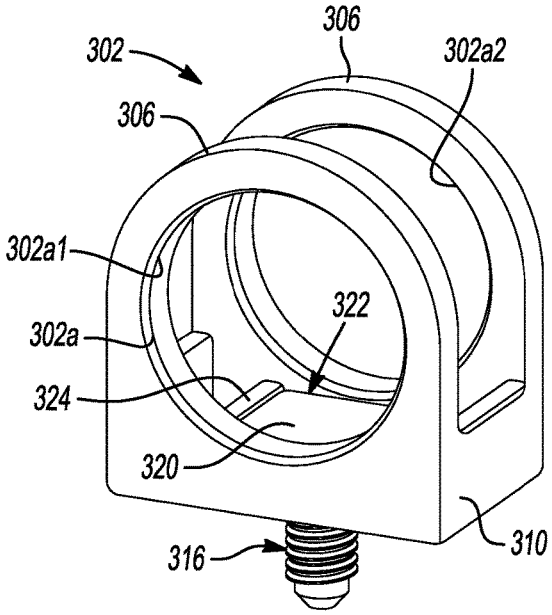
FIG. 9 is a perspective view of just the dual ring mounting bracket and the embedded fastener.

Referring now to FIGS. 7-9, a dual ring isolator assembly 300 (herein simply "isolator" 300) is shown in accordance with another embodiment of the present disclosure. The isolator 300 provides the compact size of the isolator assembly 100 but with essentially double the amount of elastomer material being incorporated to even better spread the load across a greater portion of elastomer material of the isolator, and thus enabling even lower stress on the elastomer material when the elastomer is at the full travel strain. This permits even higher stiffness for preload capacity, but with lower stress at the full travel strain.

The isolator 300 includes a mounting bracket 302 having a circular mounting bore 302*a* made up of axially aligned bores 302*a*1 and 302*a*2, and an elastomer shear hub component 304 which may be insert molded onto the mounting bracket 302. The mounting bracket 302 may be made from aluminum or any other suitably strong material which is resistant to the elements. In this embodiment the mounting bracket 302 has a unique configuration which includes dual, spaced apart circumferential rings 306 that help to form the mounting bore 302*a*. The rings 306 extend from sidewall portions 308 and merge into end walls 310. A bottom wall 312 of the mounting bracket 302 includes an aperture 314 through which a threaded shaft 318 of a fastener 316 is positioned. The fastener 316 enables the isolator 300 to be secured to an external mounting element associated with either an exhaust component or a structural portion of a vehicle. The fastener 316 also includes a head portion 320 which is shaped and of dimensions so that it resides in a pocket 322 of the mounting bracket 302, as best seen in FIG. 9. The pocket 322 may be formed by spaced apart, parallel upstanding shoulder portions or ribs 322*a* (only one being visible in FIG. 9) that project upwardly from an inside surface of the bottom wall 312. Alternatively, the pocket 322 may effectively be formed by using just one wall or shoulder portion that prevents rotation of a bolt head positioned therein. In either implementation, the pocket 322 prevents the fastener 316 from turning when a threaded nut is being tightened onto the threaded shaft 318. The fastener 316 may be over-molded (i.e., captured) within the pocket 322 during molding of the elastomer shear hub component 304. Optionally, adhesives may be used to help secure the head portion 320 to a portion of the elastomer material that lays over the head portion.

With further reference to FIGS. 7 and 8, the elastomer shear hub component 304 includes a unique mirror image, tandem outer diameter ("OD") and inner diameter ("ID") shear hub configuration. This configuration is facilitated by an OD shear hub 324 which is extends between the two circumferential rings 306, and a pair of ID shear hubs 326 (or "ID shear hub portions" 326), formed by voids 328, which are coupled to the OD shear hub 324 by a transition portion 325. In this example the ID shear hubs 326 and the voids 328 are mirror images of one another, although in practice they do not necessarily have to have precise, mirror image configurations. Likewise, while the transition portion 325 is shown in FIGS. 7 and 8 being disposed at an axial midpoint of the OD shear hub 324, the transition portion could be offset from the axial center of the OD shear hub if desired.

It will also be appreciated that while the rings 306 are shown in FIGS. 7-9 as forming a complete circle, such a configuration could be modified. For example, the rings 306 could form a pair of parallel arches. Still further, the rings 306 need not be circular in shape, but could be modified to be non-circular, and thus take virtually any other shape, to even better meet the needs of a specific application.

The OD shear hub 324 and both of the ID shear hubs 326 are located between the end walls 310 of the mounting bracket 302 and thus do not extend axially outwardly from the end walls 310, as with the isolator 100. However, the OD shear hub 324 and the ID shear hub 326 could alternatively be formed such that one, or both, extend axially outwardly from the end walls 310 to further restrict sliding. The ID shear hubs 326 are further radially offset from a radial center of the mounting bore 302*a*. A central mounting bore 330 extends co-linearly through the ID shear hubs 326 to allow a portion of an external hanger to be received therein. The central mounting bore 330 is thus also radially offset from the radial center of the mounting bore 302*a* in order to provide a vertical offset for preload sag.

With further reference to FIG. 8, a compression bumper portion 332 of the ID shear hubs 326 projects toward the bottom wall 312. A partial circumferential void 334, visible in FIGS. 7 and 8, is formed by the removal of a portion of material forming the transition portion 325 adjacent the bottom wall 312. This decouples tension stress for travel away from the bottom wall 312.

Figure 10:
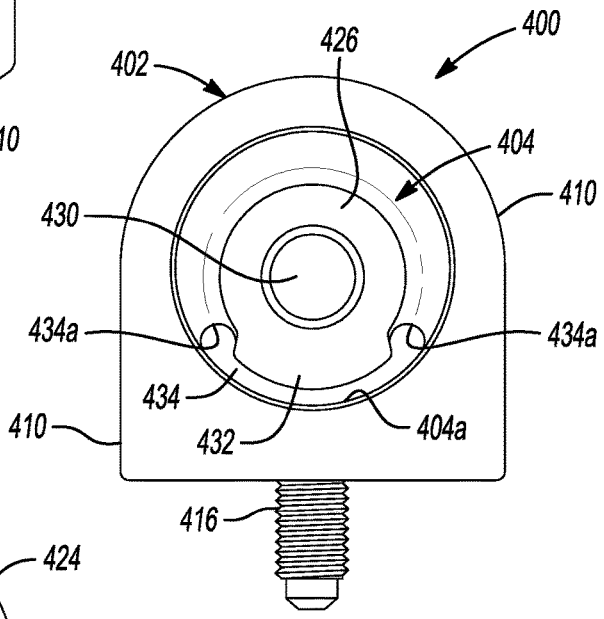
FIG. 10 is a front view of another embodiment of the present disclosure showing a dual ring mounting bracket with an OD shear hub and a mirror image pair of ID shear hubs, but where a compression bumper of the shear hubs extends a full axial length of the pair of ID shear hubs.
Figure 11:
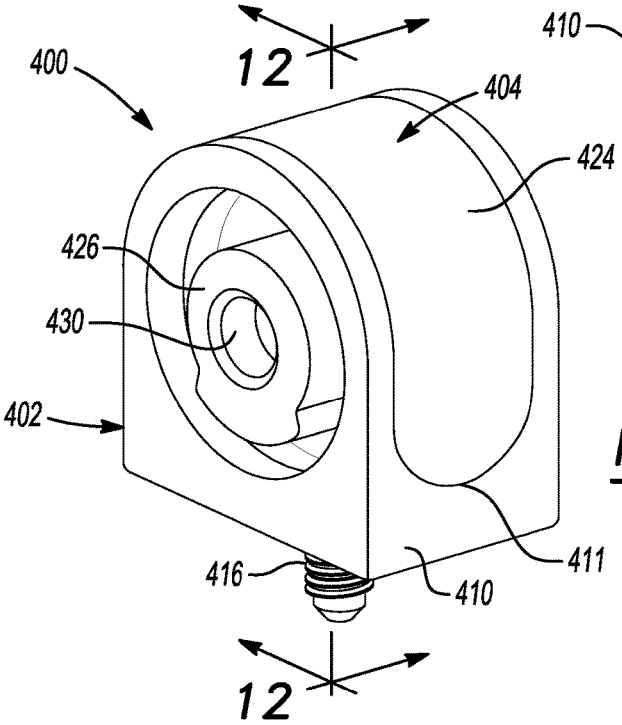
FIG. 11 is a perspective view of the assembly of FIG. 10.
Figure 12:
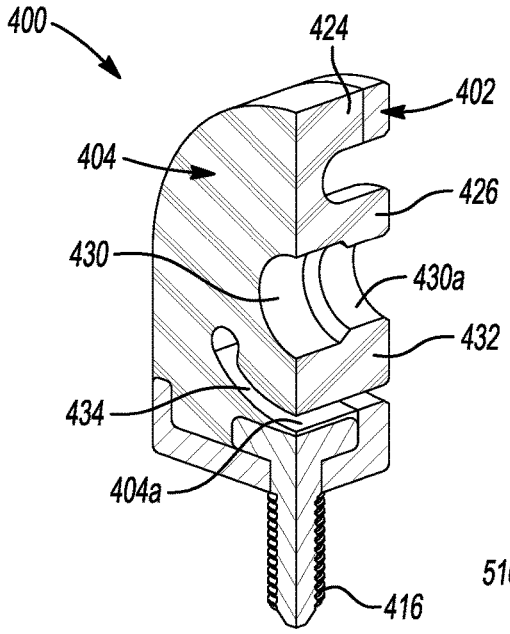
FIG. 12 is a quarter sectional view of a portion of the assembly of FIG. 11 taken in accordance with section line 12-12 in FIG. 11.

Referring to FIGS. 10-12, an isolator assembly 400 in accordance with another embodiment of the present disclosure is shown. Isolator assembly 400 is similar in some respects to isolator 300 and incorporates a dual ring mounting bracket 402 which in this example is identical to mounting bracket 302 except for a large blend 411 to end wall 410 and removal of ribs 322*a*. An elastomer shear hub component 404 is included which is similar to elastomer shear hub component 304 in that it includes an OD shear hub portion 424 and a mirror image pair of ID shear hub portions 426. A central mounting bore 430 extends through the ID shear hub portions 426. A fastener 416 is over-molded within the mounting bracket 402 in a manner identical to fastener 316. In this embodiment, however, a compression bumper portion 432 is included, formed in part by void 434, which extends along a full axial length of the ID shear hub portions 426. The radius of curvature of the compression bumper portion 432 in this example is the same as the radius of curvature of a lower wall portion 404*a* of the elastomer shear hub component 404, although the two surfaces need not necessarily be perfectly identical in radius of curvature. The increased surface area and elastomer material provided by the full axial length compression bumper portion 432 even further helps to reduce compressive stress when a ground out condition occurs. The void 434 preferably also incorporates increased radius stress relief portions 434*a* at its opposite ends. The width of void 434, as well as its circumferential length, may vary significantly. However, in most instances the width of the void 434 may be between about 2 mm and the full thickness of the elastomer shear hub component 404. The void 434 enables the decoupling of tension elements to adjacent side portions of the elastomer shear hub component 404.

An additional benefit of the isolator 400 of FIGS. 10-12 results from an added amount of material at an outer end of one of the ID shear hubs 426 which forms a small ridge 430*a*. The ridge 430*a* acts as an interference section on an inner diameter of the ID shear hub 426, as shown in FIG. 12. The ridge 426*a* even further helps the isolator assembly 400 to avoid any possible noise and/or contamination issues resulting from a less than perfect coupling with an end portion of an external hanger positioned in the central mounting bore 430.

Figure 13:
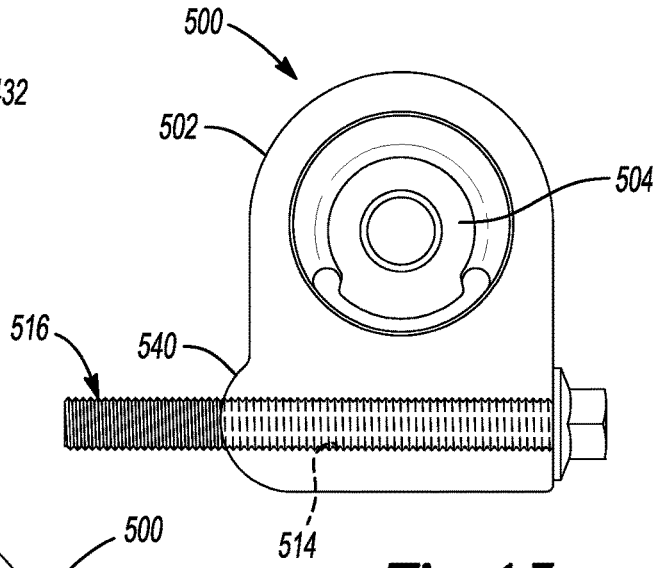
FIG. 13 is a front elevational view of another embodiment of a dual ring isolator assembly in accordance with the present disclosure in which a clamp face of a dual ring mounting bracket has a bore extending therethrough parallel to a bottom face of the mounting bracket, to provide a through-bolt bracket configuration.
Figure 14:
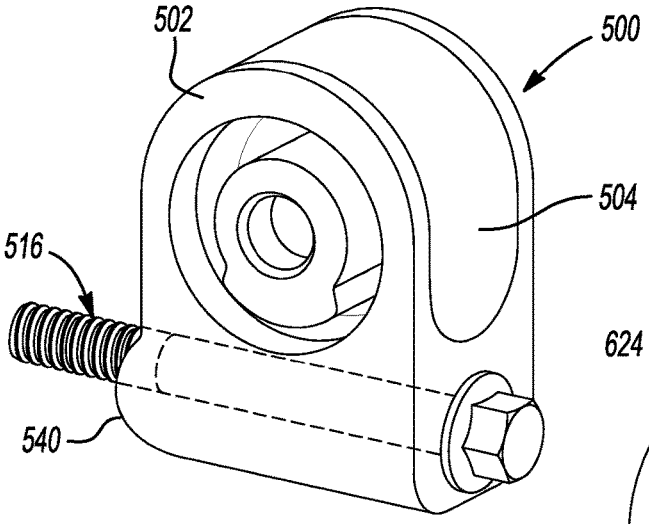
FIG. 14 is a perspective view of the isolator assembly of FIG. 13.

Referring to FIGS. 13 and 14, an isolator assembly 500 is shown in accordance with another embodiment of the present disclosure. The isolator assembly 500 is similar to the isolator assembly 400 and includes a mounting bracket 502 which houses an elastomeric isolator component 504. The elastomeric isolator component 504 is identical to the component 404 shown in FIGS. 10-12 with the exception that the mounting bracket 502 is formed with a through bore 514 through which a threaded fastener 516 is inserted. A clamp face 540 may be a conventional flat surface with an anti-rotation feature. Alternatively, the clamp face 540 may be an extruded arch joint, as shown in FIGS. 13 and 14, or possibly may even have a V-block configuration. This permits a clamping attachment of the mounting bracket 502 to an optimized small face with precise clocking (i.e., precise angular orientation).

Figure 15:
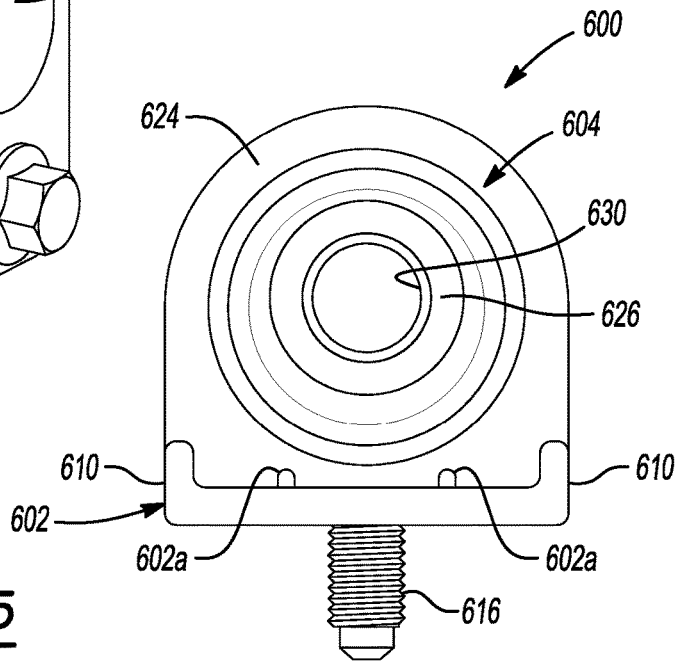
FIG. 15 is another embodiment of an isolator assembly in accordance with the present disclosure in which no void is formed between the OD shear hub and the ID shear hubs to decouple rubber tension to the bolt head.

Referring to FIG. 15, an isolator assembly 600 is shown in accordance with another embodiment of the present disclosure. The isolator assembly 600 is similar to the isolator 300 and includes a mounting bracket 602 within which an elastomer shear hub component 604 is molded, and which encapsulates a head portion of a threaded fastener 616. The elastomer shear hub component 604 includes an OD shear hub 624, an ID shear hub 626, and a bore 630 extending through ID shear hub. The isolator assembly 600 differs, however, in that no void is included in the elastomer shear hub component 604. The lack of a void 334 or 434 provides an even higher ground out rating for the isolator assembly 600. In addition, the mounting bracket 602 has bracket ribs 602*a* which are removed , and the end walls 610 are of reduced height as well. These modifications even further reduce the stress on the elastomer material. Still another embodiment could have the isolator assembly 600 with an even taller overall height as a result of making the OD shear hub 624 section, which lays above the bolt head of the fastener, even thicker.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

It is claimed:

1. An isolator assembly for supporting an exhaust component from a structural portion of a vehicle, the isolator assembly comprising:

a mounting bracket having a pair of spaced apart rings defining a mounting bore; and an elastomer shear hub component disposed within the mounting bracket, the elastomer shear hub component including an elastomeric outer diameter (OD) shear hub portion extending between the pair of spaced apart rings, and a tubular elastomeric inner diameter (ID) shear hub portion disposed within the OD shear hub portion, the ID shear hub portion defining a central mounting bore adapted to receive an external hanger component.

2. The isolator assembly of claim 1, further comprising a fastener extending from the mounting bracket for enabling the mounting bracket to be secured to an external component.

3. The isolator assembly of claim 1, wherein the ID shear hub portion comprises a mirror image pair of ID shear hubs that include the central mounting bore extending co-linearly therethrough.

4. The isolator assembly of claim 1, wherein the mirror image pair of ID shear hubs is coupled to the OD shear hub portion by a transition portion.

5. The isolator assembly of claim 1, wherein the mounting bracket defines a pair of end walls, and wherein the OD shear hub portion and the ID shear hub portion extend axially at least flush to the pair of end walls.

6. The isolator assembly of claim 1, wherein the ID shear hub portion and the central mounting bore are both radially offset from a radial center of the mounting bore of the mounting bracket.

7. The isolator assembly of claim 2, wherein the fastener is captured on the mounting bracket by the elastomer shear hub component.

8. The isolator assembly of claim 1, further comprising a void formed between the OD shear hub portion and the ID shear hub portion.

9. The isolator assembly of claim 8, wherein the void is disposed adjacent a bottom wall portion of the mounting bracket.

10. The isolator assembly of claim 3, further comprising a void formed between the mirror image pair of ID shear hubs and the OD shear hub portion.

11. The isolator assembly of claim 10, wherein the void is disposed adjacent a bottom wall portion of the mounting bracket.

12. The isolator assembly of claim 8, further comprising a compression bumper formed on the ID shear hub portion, the compression bumper projecting from the ID shear hub portion generally towards a bottom wall portion of the mounting bracket.

13. The isolator assembly of claim 12, wherein the compression bumper extends a full axial length of the ID shear hub.

14. The isolator assembly of claim 10, further comprising a compression bumper formed on the mirror image pair of ID shear hubs, the compression bumper projecting from the mirror image pair of ID shear hubs generally toward a bottom wall portion of the mounting bracket.

15. The isolator assembly of claim 14, wherein the compression bumper extends along a full axial length of the mirror image pair of ID shear hubs.

16. The isolator assembly of claim 1, wherein the mounting bracket further comprises a bottom wall portion and a through bore extending through the bottom wall portion generally parallel to the bottom wall, and wherein a fastener is disposed in the through bore.

17. The isolator assembly of claim 1, wherein the central mounting bore of the ID shear hub portion includes an interference section having an added amount of elastomer material to define a ridge.

18. The isolator assembly of claim 1, wherein the pair of spaced apart rings of the mounting bracket are disposed parallel to one another.

19. An isolator assembly for supporting an exhaust component from a structural portion of a vehicle, the isolator assembly comprising:

a mounting bracket including parallel spaced apart sidewalls interconnected by a bottom wall, each sidewall including an aperture aligned along a common axis defining a mounting bore; and an elastomer shear hub component disposed within the mounting bracket, the elastomer shear hub component including an outer diameter (OD) shear hub portion extending between the pair of spaced apart sidewalls, and a tubular elastomeric inner diameter (ID) shear hub portion disposed within the OD shear hub portion and connected to the OD shear hub portion via a transition portion, the ID shear hub portion including a pair of ID shear hub protrusions extending in generally opposite directions that define a common, central mounting bore adapted to receive an external hanger component.

20. The isolator assembly of claim 19, further comprising:

a fastener extending from the mounting bracket for enabling the mounting bracket to be secured to an external component.

21. The isolator assembly of claim 19, wherein the pair of ID shear hub protrusions extend longitudinally and parallel to the OD shear hub portion, and wherein the transition portion extends radially and connects the pair of ID shear hub protrusions to the OD shear hub portion.

22. An isolator assembly for supporting an exhaust component from a structural portion of a vehicle, the isolator assembly comprising:

a mounting bracket having a pair of spaced apart rings defining a mounting bore, and a bottom wall having an aperture;

an elastomer shear hub component disposed within the mounting bracket, the elastomer shear hub component including an outer diameter (OD) shear hub extending between the pair of spaced apart rings, and a tubular elastomeric inner diameter (ID) shear hub disposed within the OD shear hub and connected to the OD shear hub via a transition portion, the ID shear hub including a pair of mirror image ID shear hub portions extending in generally opposite directions that define a co-linear central mounting bore adapted to receive an external hanger component; and the mirror image pair of ID shear hub portions being coupled at an approximate midpoint along an axial length thereof to an approximate midpoint of the OD shear hub by the transition portion.

23. The isolator assembly of claim 22, further comprising a fastener extending through an aperture in the bottom wall and captured by a portion of elastomer material forming the elastomer shear hub, the fastener enabling the mounting bracket to be secured to an external mounting implement.

24. The isolator assembly of claim 22, wherein the spaced apart circumferential rings are not round.

25. The isolator assembly of claim 22, wherein the spaced apart rings comprise a pair of arches.

26. The isolator assembly of claim 22, wherein the mounting bracket includes at least one through bolt hole for receiving an external fastener.

27. The isolator assembly of claim 26, wherein the through bolt hole is orientated parallel to the elastomer shear hub component.

* * * * *